US008289213B2

(12) United States Patent
Duchesne et al.

(10) Patent No.: US 8,289,213 B2
(45) Date of Patent: Oct. 16, 2012

(54) MULTI-BAND ANTENNA FOR SATELLITE POSITIONING SYSTEM

(75) Inventors: Luc Duchesne, Angervilliers (FR); Marc Le Goff, Les Ulis (FR); Lars Foged, Aprilia (IT); Jean-Marc Baracco, Vence (FR)

(73) Assignee: The European Union, Represented by The European Commission (BE)

( * ) Notice: Subject to any disclaimer, the term of this patent is extended or adjusted under 35 U.S.C. 154(b) by 590 days.

(21) Appl. No.: 11/995,365

(22) PCT Filed: Jul. 10, 2006

(86) PCT No.: PCT/EP2006/064067

§ 371 (c)(1),
(2), (4) Date: Aug. 19, 2009

(87) PCT Pub. No.: WO2007/006773

PCT Pub. Date: Jan. 18, 2007

(65) Prior Publication Data

US 2010/0134378 A1 Jun. 3, 2010

(30) Foreign Application Priority Data

Jul. 12, 2005 (EP) ..... 05106370

(51) Int. Cl.
*H01Q 1/38* (2006.01)

(52) U.S. Cl. ..... 343/700 MS; 343/841; 343/702; 343/872

(58) Field of Classification Search ..... None
See application file for complete search history.

(56) References Cited

U.S. PATENT DOCUMENTS

| | | | | |
|---|---|---|---|---|
| 4,804,968 | A * | 2/1989 | Ohe et al. | 343/713 |
| 5,309,163 | A * | 5/1994 | Ngan et al. | 343/700 MS |
| 5,594,455 | A * | 1/1997 | Hori et al. | 343/700 MS |
| 6,054,953 | A | 4/2000 | Lindmark et al. | |
| 6,552,685 | B2 * | 4/2003 | Zhang | 343/700 MS |
| 7,196,674 | B2 * | 3/2007 | Timofeev et al. | 343/810 |
| 2003/0201948 | A1 * | 10/2003 | Phelan et al. | 343/895 |

(Continued)

FOREIGN PATENT DOCUMENTS

JP 07007321 1/1995

(Continued)

OTHER PUBLICATIONS

Dusseux T., et al. "S-Band Diplexing Radiating Element Design." Proceedings of the Antennas and Propagation Society Annual Meeting, Jun. 1991.

(Continued)

*Primary Examiner* — Trinh Dinh
(74) *Attorney, Agent, or Firm* — Cantor Colburn LLP

(57) ABSTRACT

A stacked multi-band antenna for a satellite positioning system comprises a stack of conductive patches, which are each dimensioned so as to be respectively operative in a dedicated frequency band. An excitation line section comprising pairs of conductive strips is arranged underneath the stack of conductive patches. Each pair of conductive strips is adapted for radiatively coupling to an associate conductive patch of the stack of conductive patches. An RF front end with at least one electric circuit is arranged in a triplate section underneath the excitation line section for operatively connecting the pairs of conductive strips to a satellite positioning receiver. The at least one electric circuit includes filters and amplifiers for respectively filtering and amplifying signals from the pairs of conductive strips, during antenna operation.

12 Claims, 5 Drawing Sheets

U.S. PATENT DOCUMENTS

| | | | | |
|---|---|---|---|---|
| 2004/0189527 | A1 | 9/2004 | Killen | |
| 2004/0239565 | A1 | 12/2004 | Brachat | |
| 2004/0263392 | A1 | 12/2004 | Bisiules et al. | |
| 2005/0052321 | A1 | 3/2005 | Lee et al. | |
| 2005/0140564 | A1 * | 6/2005 | Deguchi et al. | 343/866 |
| 2007/0120748 | A1 * | 5/2007 | Jenwatanavet et al. | 343/702 |

FOREIGN PATENT DOCUMENTS

| | | | |
|---|---|---|---|
| JP | 07321548 | | 8/1995 |
| JP | 10274535 | A | 10/1998 |
| JP | 10335924 | | 12/1998 |
| JP | 2001 060823 | | 3/2001 |
| JP | 2004215193 | | 7/2004 |
| RU | 2201601 | | 3/2003 |

OTHER PUBLICATIONS

Pozar, D.M., et al. "A Dual-Band Circularly Polarized Aperture-Coupled Stacked Microstrip Antenna for Global Positioning Satellite." IEEE Transactions on Antennas and Propagation, IEEE Inc., New York, US, vol. 45 No. 11, Nov. 1997.

International Search Report; PCT/EP2006/064067; Date mailed Aug. 11, 2006.

Japanese Office Action; Application No. P2008-520864; Mail date May 30, 2012: Citing reference JP10274535.

* cited by examiner

MULTI-BAND ANTENNA FOR SATELLITE POSITIONING SYSTEM

CROSS-REFERENCE TO RELATED APPLICATIONS

The present application is a national stage application of PCT/EP2006/064067, filed Jul. 10, 2006, which claims priority to EP 05106370.9, filed on Jul. 12, 2005. The content of both of these applications is incorporated herein by reference.

TECHNICAL FIELD OF THE INVENTION

The present invention relates to an antenna for a satellite positioning system, more particularly to a multi-band stacked-patch antenna.

BACKGROUND OF THE INVENTION

Satellite navigation systems operate in multiple frequency bands in order to reduce multipath effects and ionospheric or tropospheric errors so as to ultimately provide enhanced positioning accuracy to the user. The existing GPS (Global Positioning System), for instance, uses signals in the L1 frequency band, centred at 1575.42 MHz, and in the L2 band, centred at 1227.6 MHz. The coming European Galileo positioning system will operate in a different set of frequency bands, e.g. the E5 band (1164-1215 MHz), the E6 band (1260-1300 MHz) and the E2-L1-E1 band (1559-1593), called hereinafter "L1-band" for simplicity. In order to profit from the increased positioning capabilities and to be able to use different positioning services, a user needs receiver/transmitter infrastructure capable of operating at a plurality of frequencies.

Multi-band stacked patch antennas are known in the field of satellite positioning systems. A multi-frequency antenna with reduced rear radiation and reception is e.g. disclosed in US patent application 2005/0052321 A1. Such a multi-band antenna typically comprises a stack of dielectric substantially planar substrates, with a conductive layer disposed on a surface of each substrate. Each conductive layer is associated with a specific frequency band and configured so as to be resonant within the respective frequency band. The patches are parasitically coupled through slots to feeding microstrip lines applied on the rear surface of the undermost dielectric substrate. Another antenna for satellite positioning applications is described in "A Dual Band Circularly Polarized Aperture-Coupled Stacked Microstrip Antenna for Global Positioning Satellite", Pozar et al., IEEE Transactions on Antennas and Propagation, Vol. 45, No. 11, November 1997. Pozar's antenna includes a stacked arrangement of first and second antenna patches, a crossed slot feed and a microstrip feed network. The latter includes power combiners to sum the signals of the microstrips with the correct relative phase.

Other antennas, not specifically related to satellite positioning applications and/or multi-band operation are e.g. known from US 2004/0189527 A1 disclosing a crossed slot-fed microstrip antenna, U.S. Pat. No. 6,054,953 an aperture-coupled dual-band antenna, US 2004/0263392 A1 a multi-band base station antenna for communicating with terrestrial mobile devices and US 2004/0239565 A1 a printed dual-band antenna.

Important issues in satellite positioning systems are multipath effects and phase-centre stability. Multipath signals are due to reflections at surfaces in the surroundings of the antenna and they constitute a limiting factor for the determination of position. The nearer the reflecting surface is to the antenna, the more difficult it becomes for the receiver to mitigate the effect of multipath. In order to reduce short-distance multipath effects, the reception pattern of the antenna has to be tailored.

Phase centre variations over frequency are another limiting factor for position determination and also have to be minimised at antenna level. The change of the phase centre with temperature is a further parameter, which shall be minimised.

In satellite navigation systems, typical signal levels are of the order of −130 dBm (L1 band) and −125 dBm (E5/E6 band), which sets relatively severe requirements for the RF front end. Additionally, out-of-band rejection shall be very high, especially if the antenna is to be used in an environment with high RF interference levels, such as e.g. avionics.

Another important point is group delay variation with frequency. Group delay is mainly due to those parts of electric circuits that are based on resonant sections. Group delay variations shall be kept low over a given frequency band so that the position can be accurately determined. Additionally, change of group delay with temperature for a given frequency shall be minimised.

SUMMARY OF THE INVENTION

The invention provides an improved stacked multi-band antenna.

Such a stacked multi-band antenna for a satellite positioning system comprises a stack of conductive patches, which are each dimensioned so as to be respectively operative in a dedicated frequency band. According to an important aspect of the invention, an excitation line section, which comprises pairs of conductive strips, is arranged underneath said stack of conductive patches. Each pair of conductive strips is adapted for radiatively coupling to an associate conductive patch of the stack of conductive patches. The antenna further comprises an RF front end with at least one electric circuit arranged in a triplate section underneath the excitation line section for operatively connecting the pairs of conductive strips to a satellite positioning receiver. The at least one electric circuit includes filters and amplifiers for respectively filtering and amplifying signals from the pairs of conductive strips, during antenna operation. The RF front end preferably has separate circuits for the different frequency bands. This allows independent impedance matching, feeding, filtering and amplifying. In case of two frequency bands, the antenna thus presents self-diplexing properties. The triplate shields the at least one electric circuit. Most preferably, the conductive strips of each pair of conductive strips are substantially orthogonal one to the other. When circular-polarised signals are received or emitted, the signals in the conductive strips of each pair of conductive strips have a phase difference of 90 degrees. The compact configuration of the antenna provides high phase-centre stability.

In a preferred embodiment of the invention, each one of the pairs of conductive strips comprises two conductive strips of similar or equal length extending at right angle radially from a virtual point of intersection, which is located centrally underneath the conductive patches. Additionally, the conductive strips may be arranged in an X-shaped configuration, the first conductive strip of the first pair being aligned with the first conductive strip of the second pair and the second conductive strip of the first pair being aligned with the second conductive strip of the second pair. It shall be noted that each pair of conductive strips can comprise dedicatedly shaped excitation lines, which can be different from pair to pair. The conductive strips can be substantially straight or comprise a curved portion.

The conductive patches can have any shape allowing good reception of signals in their respective frequency bands. As an example, they can be quadratic or hexagonal, but preferably the stack of conductive patches comprises rotationally symmetric conductive patches, such as a disk-shaped conductive patch and an annular conductive patch.

According to a most preferred embodiment of the invention, the stack of conductive patches comprises a first conductive patch dimensioned so as to be operative in a first frequency band (e.g. the L1 band) and a second conductive patch dimensioned so as to be operative in a second frequency band distinct from the first frequency band (e.g. the E5/E6 band in case of the Galileo satellite system or the L2 band in case of GPS). A first pair of conductive strips for radiatively coupling to the first conductive patch and a second pair of conductive strips for radiatively coupling to the second conductive patch are provided in said excitation line section, which respectively comprise a first and a second strip arranged substantially perpendicular to each other within the excitation line section. The antenna further comprises, e.g. in the triplate section, a first electric circuit for connecting the first pair of conductive strips to a satellite positioning receiver and a second electric circuit for connecting the second pair of conductive strips to a satellite positioning receiver. Preferably, there is no electrical contact between the first and the second circuit, which allows tailoring them dedicatedly for their associated frequency bands.

The circuits preferably comprise an impedance matching network, a feeding network, at least one filtering stage and low-noise amplifiers. Each circuit can be optimised so as to present maximal transmission of signals of the respective frequency band, while out-of-band signals are reflected or attenuated. The matching, feeding and amplification components can be chosen so that they present additional filtering capabilities in the respective frequency band. Consequently, the specifications for the filtering stage itself may be relaxed, which may result in more compact, stable and less costly electric circuits.

In order to adapt the electric circuits for circular-polarised signals, the first electric circuit comprises a first coupling stage for combining first frequency signals to or from the first strip of the first pair of conductive strips and first frequency signals to or from the second strip of the first pair of conductive strips with a relative phase difference of 90 degrees and the second electric circuit comprises a second coupling stage for combining second frequency signals to or from the first strip of the second pair of conductive strips and second frequency signals to or from the second strip of the second pair of conductive strips with a relative phase difference of 90 degrees. The skilled person will note that each coupling stage can comprise one or more than one couplers, for instance three couplers, in each of said first and second electric circuit. A balanced excitation or sensitivity with respect to the first frequency signals and the second frequency signals can thereby be achieved.

The first electric circuit may comprise a band-pass filter and an amplifier for filtering, respectively amplifying, the combined first frequency signals from the first pair of conductive strips and the second electric circuit may comprise a band-pass filter and an amplifier for filtering, respectively amplifying, the combined second frequency signals from the second pair of conductive strips.

When appropriate, at least the second electric circuit can comprise a diplexer with two band-pass filters for selecting two narrower frequency bands within the second frequency band. If, for instance, the second frequency band contains the E5 band and the E6 band, E5 signals can be filtered separately from the E6 signals, which results in an improved signal-to-noise ratio.

For supporting the conductive patches, the antenna may comprise dielectric substrate layers, whereupon the conductive patches can be printed or deposited. The conductive patches can e.g. be made of copper, plated with a tin-lead alloy. The conductive patches on their supports, the excitation line section and the triplate can be stacked one on top of the other, with or without air gaps between them.

For reducing rear-incident radiation, the antenna may comprise a metallic container having a cavity therein, wherein the stack of conductive patches and the excitation line section are arranged. Rear-incident radiation may also be reduced by a choke arranged on the side opposed to the conductive patches. Such a choke can be an integral part of the metallic container or be achieved as a separate element of the antenna. For instance, the rear-sided plate of the metallic container can be corrugated (provided with choke rings).

As will be appreciated, the antenna may comprise a radome for protection. Such a radome is appropriate when the antenna is to be used outdoors. The radome can be made of conventional materials like polymethyacrylate, polycarbonates or expoxy resin with glass fibres.

BRIEF DESCRIPTION OF THE DRAWINGS

Preferred, not limiting embodiments of the invention will now be described with reference to the accompanying drawings in which.

DETAILED DESCRIPTION OF THE INVENTION

Figure 1:
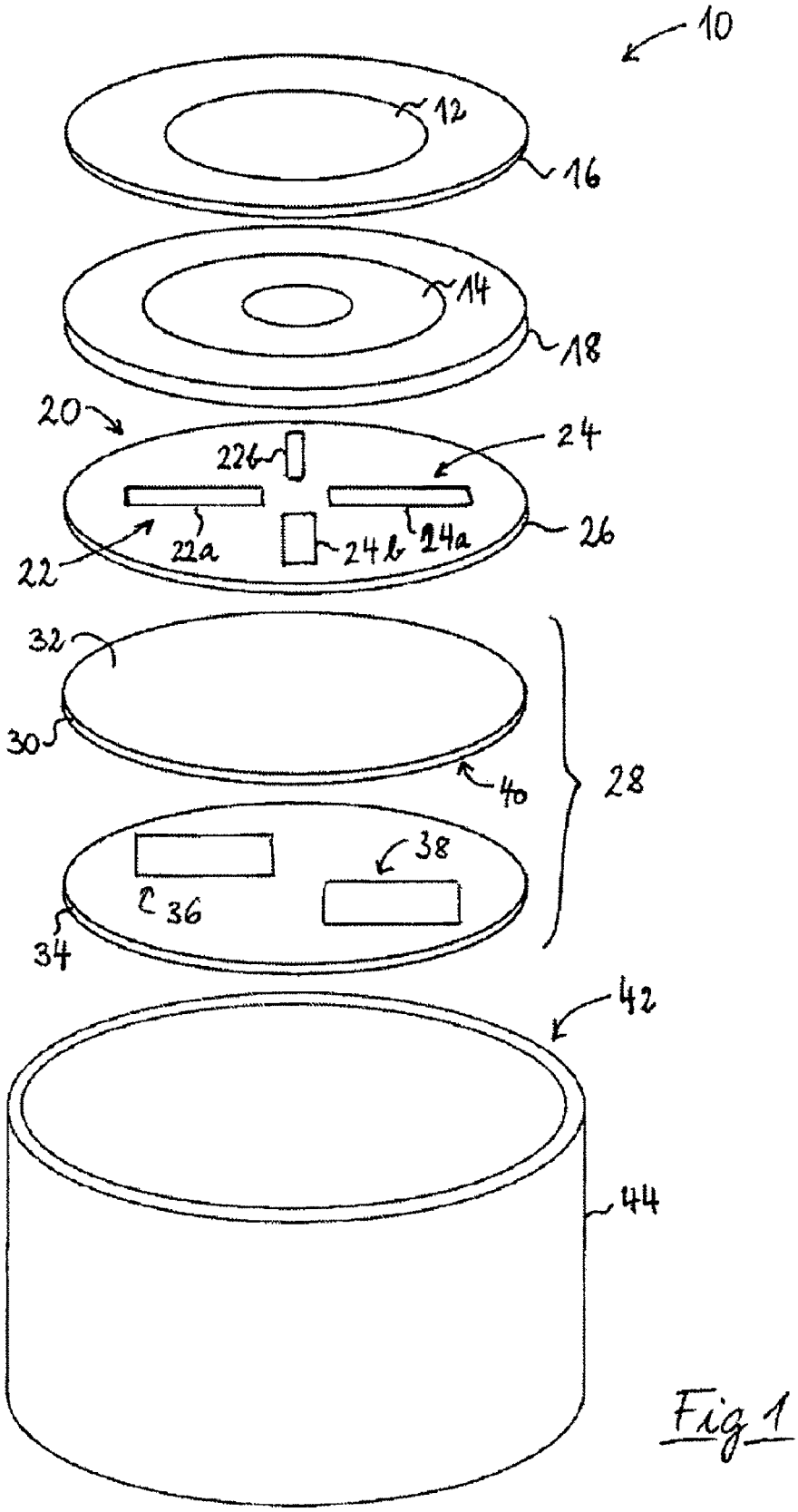
FIG. 1: is an exploded schematic view of a stacked multi-band antenna.
Figure 2:
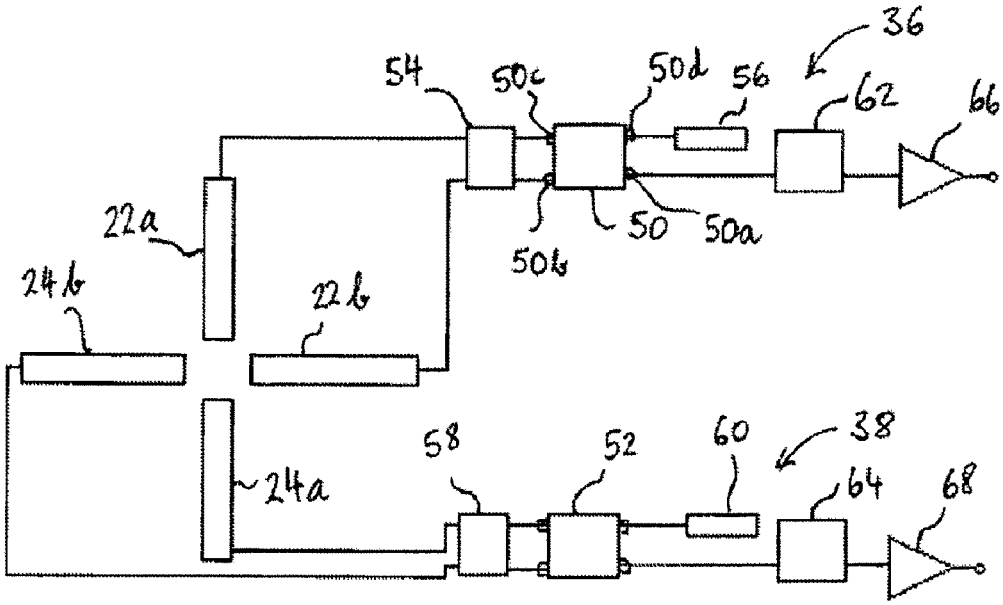
FIG. 2: is a block diagram of the RF front end connected to the conductive strips of the excitation line section.

An schematic view of a preferred embodiment of a stacked multi-band patch antenna 10 is shown in FIG. 1. The antenna comprises a stack of conductive patches 12, 14 applied each on a disk-shaped dielectric substrate 16, 18. Underneath the stacked patches an excitation line section 20 comprises two pairs 22, 24 of conductive strips 22*a*, 22*b*, 24*a*, 24*b* on a dielectric substrate 26. The conductive strips 22*a*, 22*b*, 24*a*, 24*b* are connected with an RF front end arranged in a triplate 28 under the excitation line section 20. The conductive patches 12, 14, the excitation line section 20 and the triplate 28 are arranged in substantially parallel relationship.

The conductive patches 12, 14 and the conductive strips 22*a*, 22*b*, 24*a*, 24*b* of the excitation section 20 are manufactured as printed copper layers, which can be plated with a tin-lead alloy. Alternatively, an alloy without lead can be used.

The top conductive patch 12 is a disk-shaped copper patch on a first dielectric disk 16. A second dielectric disk 18 carrying a ring-shaped conductive patch 14 is arranged under the top dielectric disk 16. The second dielectric patch 14 is positioned at a given distance from the first dielectric disk 16 by means of several spacers (not shown), which are arranged at the periphery of the dielectric discs 16, 18.

The excitation line section 20 comprises a dielectric disk 26 carrying the two pairs 22, 24 of conductive strips 22*a*, 22*b*, 24*a*, 24*b* and is arranged under the second dielectric patch 18, by means of spacers (not shown), which are located at the periphery of the disks 18, 26. The height of the stacked assembly is of the order of a few centimeters.

The lateral dimensions of the conductive patches 12, 14 are typically comprised in a range from roughly a quarter wavelength to a full wavelength of the received radio waves, so that the conductive patches 12, 14 are resonant in their respective frequency bands. In the configuration of FIG. 1, for example, the top conductive patch 12 is associated with the L1 frequency band and the second conductive patch 14 to the E5 and the E6 frequency bands. The skilled person will appreciate that the present antenna can easily be adapted to other frequency bands.

Each pair 22, 24 of conductive strips 22*a*, 22*b*, 24*a*, 24*b* comprises two copper strips, which are arranged so that a right angle is formed between them. The copper strips are not electrically contacted in the excitation line section 20. The copper strips 22*a*, 22*b*, 24*a*, 24*b* extend radially from the centre of the disk-shaped excitation line section 20, but they do not actually meet in the centre, which thus forms only a virtual point of intersection. The two pairs 22, 24 of conductive strips 22*a*, 22*b*, 24*a*, 24*b* are symmetrically arranged around the centre of the disk 26 in an X-shaped configuration: conductive strip 22*a* is aligned with conductive strip 24*a*, while conductive strip 22*b* is aligned with conductive strip 24*b*.

The configuration of the conductive patches 12, 14 and the excitation line section 20 provides good phase centre stability, high gain at low elevation angles, a low cross-polarisation level and low dielectric and ohmic losses.

The excitation line section 20 is arranged on top of a triplate 28, which comprises a dielectric disk 30 plated with copper on the surface 32 that faces the excitation line section 20. A second dielectric disk 34 carrying the RF front end with the matching, feeding, filtering and amplifying networks or circuits 36, 38 is apposed to the bottom dielectric surface 40 of the upper dielectric disk 30 of the triplate 28, so that the RF front end is sandwiched between two insulating layers. To the side facing away from the conductive patches 12, 14 and the excitation line section 20, the second dielectric disk 34 is plated with a conductive layer.

The conductive patches 12, 14 on their substrates 16, 18, the excitation line section 20 and the triplate 28 of the multiband antenna 10 are accommodated inside the cavity of a metallic container 42. The metallic container comprises a cylindrical lateral wall 44 and a base portion, which closes the rear side of the container 42 and it is open to the side of the conductive patches 12, 14. The container 42 substantially reduces the amount of radiation penetrating to the antenna 10 from its rear side. The shape of the container 42 and the relative positions of the conductive patches 12, 14 and the excitation section 20 are chosen such that the radiation pattern of the antenna 10 is as rotationally symmetrical as possible with respect to its axis.

The metallic container 42 is electrically contacted with the top and bottom conductive layers of the triplate, so that the electric circuits 36, 38 are shielded against electromagnetic radiation.

Each pair 22, 24 of conductive strips 22*a*, 22*b*, 24*a*, 24*b* is associated with a respective frequency band and with the corresponding conductive patch. The pair 22 belongs to the L1 band and the other pair 24 belongs to the E5 and E6 bands. The conductive strips 22*a*, 22*b*, 24*a*, 24*b* are not connected to the conductive patches 12, 14. They radiatively couple to the conductive patches 12, 14. Alternatively, they can be connected to the conductive patches 12, 14.

The conductive strips are connected with the matching, feeding, filtering and amplifying networks 36, 38 in the triplate 28.

The triplate section 28 comprises two separate circuits 36, 38 for the two pairs 22, 24 of conductive strips, which are now described with reference to FIGS. 2-7. The self-diplexing configuration of the antenna allows optimising the matching network, the feeding network, the filtering stage and the amplification stage separately for the E5/E6 and L1 bands.

The circuit 36 is associated to the L1 band, while the other circuit 38 is associated to the E5 and E6 bands. Downstream of the conductive strips 22*a*, 22*b*, 24*a*, 24*b*, each circuit 36, 38 comprises a coupler 50, 52 dedicated to the respective frequency band. Wiring of such a coupler will now be described with respect to the coupler 50 of circuit 36. The coupler 50 has four ports, the first port 50*a* serving to transmit the antenna signals to the satellite positioning receiver. The second port 50*b*, and the third port 50*c* are each connected with respectively one of the conductive strips 22*b*, 22*a* belonging to the same pair 22, via impedance matching network 54. The fourth port 50*d* is connected to a 50-Ohm termination 56. The coupler 50 combines the respective signals of the second port 50*b* and third port 50*c* with a phase difference of 90 degrees and outputs the combined signals on the first port 50*a*. The fourth port 50*d* serves to absorb residual power. The use of different circuits 36, 38 for the L1 band and the E5/E6 bands thus results in a preliminary separation of the L1 and the E5/E6 signals before the respective filtering stage 62, 64 and amplifying stage 66, 68. In circuit 38, reference numeral 58 designates the impedance matching network for the pair of conductive strips 24, reference numeral 60 designates a 50-Ohm termination.

The filtering stages 62, 64 and the amplifying stages 66, 68 are also arranged in the triplate 28, so as to keep the electrical connection lines as short as possible. This has the benefit of low losses due to connection lengths. The filtering stages 62, 64 are located just before the amplifying stages 66, 68 in order to reject all out-of-band interference, which could cause the amplifiers to saturate.

FIGS. 3-7 show several embodiments of the filtering stages 62, 62 and amplifying stages 66, 68 of the antenna 10.

Figure 3:
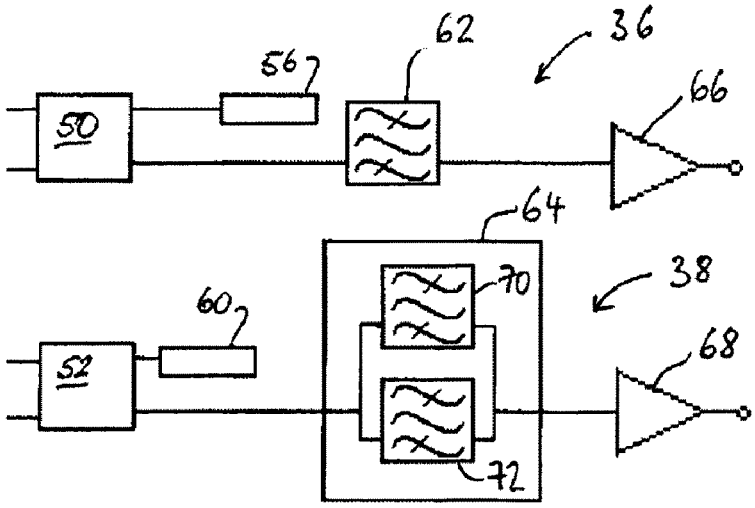
FIG. 3: is a block diagram of a first embodiment of the feeding, filtering and amplifying networks.

In the embodiment of FIG. 3, the first port of coupler 50 of circuit 36 associated with the L1 band is connected to a filtering stage 62 consisting of a band-pass filter for filtering unwanted frequency components outside the L1 band. The filtered L1 signal is then amplified by the low-noise amplifier of amplifier stage 66. Regarding circuit 38, associated to the E5 and E6 bands, an integrated diplexer and combiner is used as filtering stage 64. The filtering stage comprises two band-pass filters 70, 72 for respectively band-pass filtering the E5 signals and the E6 signals. The diplexer/combiner is located downstream of the first port of coupler 52. After filtering, the E5 and E6 signals are recombined and amplified in a low-noise amplifier 68, before they are fed to the connector for the satellite positioning receiver.

Figure 4:
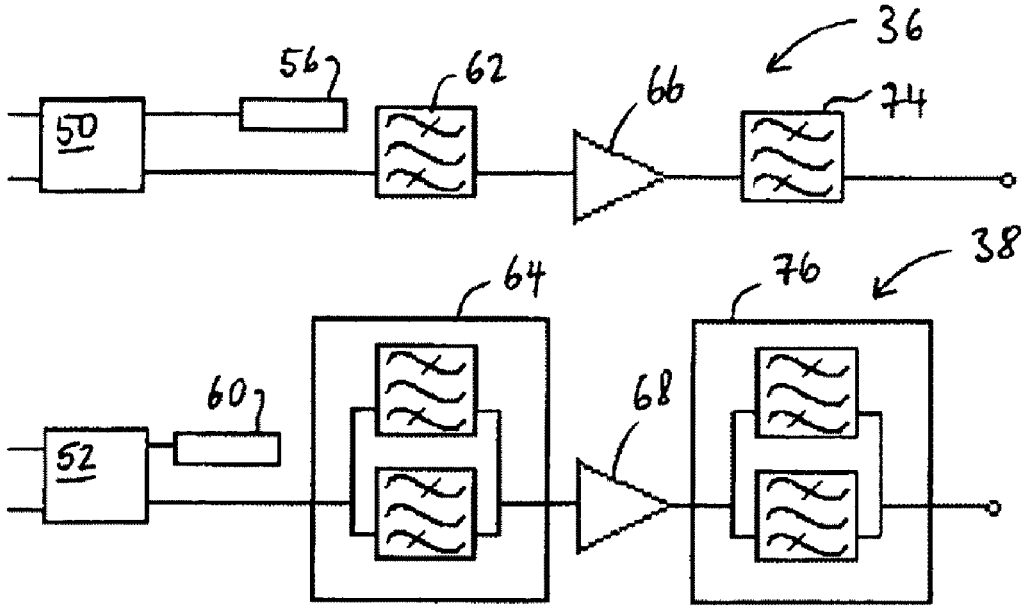
FIG. 4: is a block diagram of a second embodiment of the feeding, filtering and amplifying networks.

FIG. 4 shows the embodiment of FIG. 3 with additional filtering stages 74, 76 downstream of amplification stages 66, 68. Diplexer/combiner 76 in circuit 38 comprises a band-pass filter for the E5 band and a band-pass filter for the E6 band.

Figure 5:
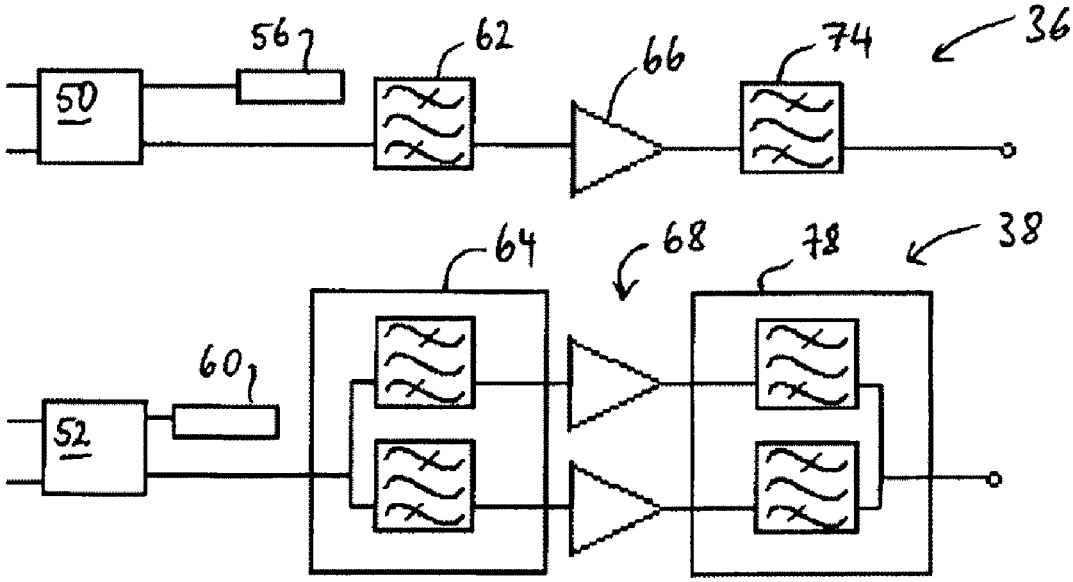
FIG. 5: is a block diagram of a third embodiment of the feeding, filtering and amplifying networks.

In FIG. 5, filtering stage 64 comprises a diplexer without combiner capability. Filtered E5 and E6 signals are separately amplified by different amplifiers of amplification stage 68. Recombination of E5 and E6 signals takes place downstream of the amplification stage 68 in combiner 78, which comprises band-pass filters for filtering the E5 and E6 signals separately.

Figure 6:
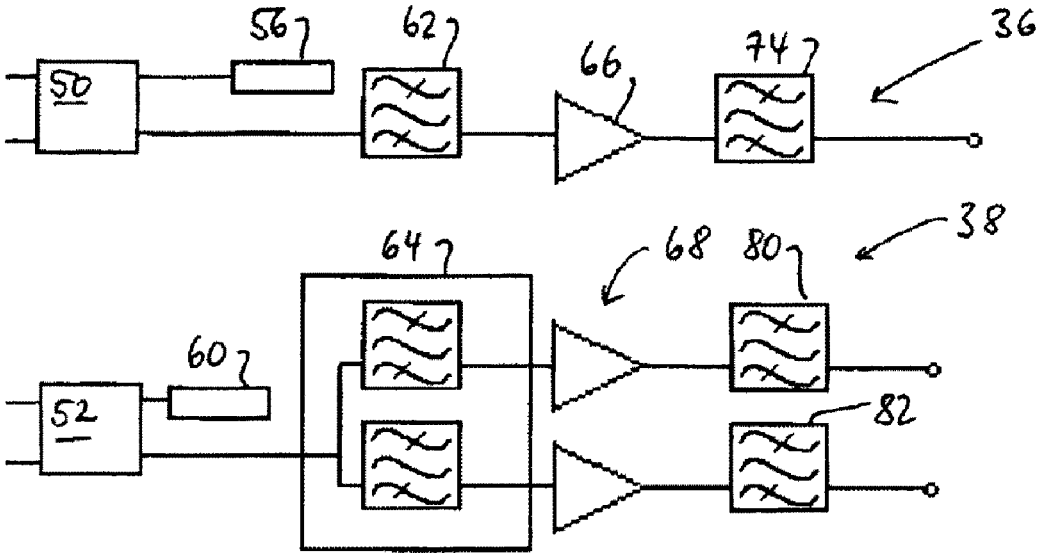
FIG. 6: is a block diagram of a fourth embodiment of the feeding, filtering and amplifying networks.
Figure 7:
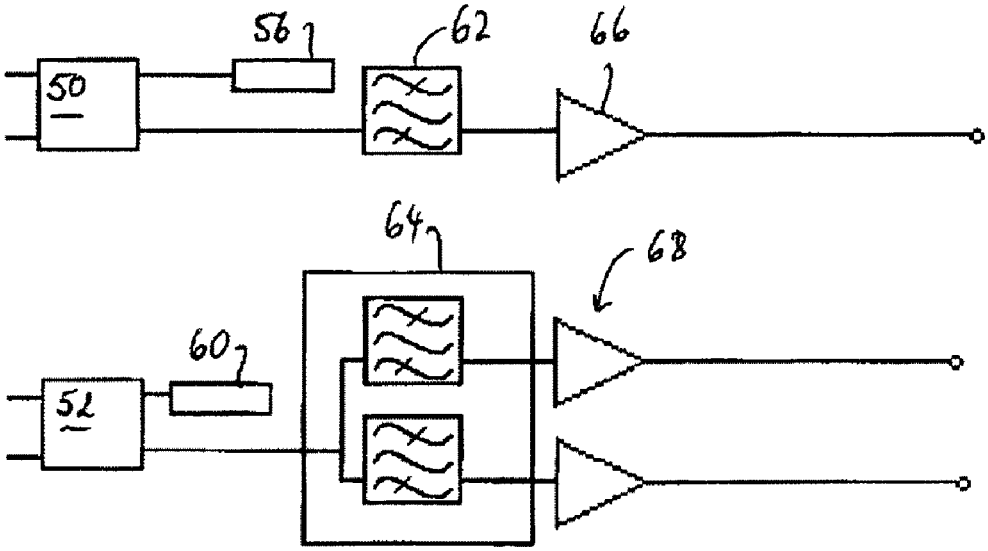
FIG. 7: is a block diagram of a fifth embodiment of the feeding, filtering and amplifying networks.

As shown in FIGS. 6 and 7, E5 and E6 signals can be fed separately to the satellite positioning receiver, omitting recombination of the amplified signals. After amplification, the signals can be directly fed to the receiver or after bandpass filtering in filters 74, 80, 82, respectively.

Because the embodiments shown in FIGS. 3 and 4 involve only two low-noise amplifiers, instead of three as in FIGS. 4 to 7, they have the advantage of lower power consumption and costs. As the additional filtering stages 74, 76 increase the group delay variations over frequency, and degrade the group delay stability over temperature, the embodiment of FIG. 3 is preferred over the embodiment of FIG. 4.

Figure 8:
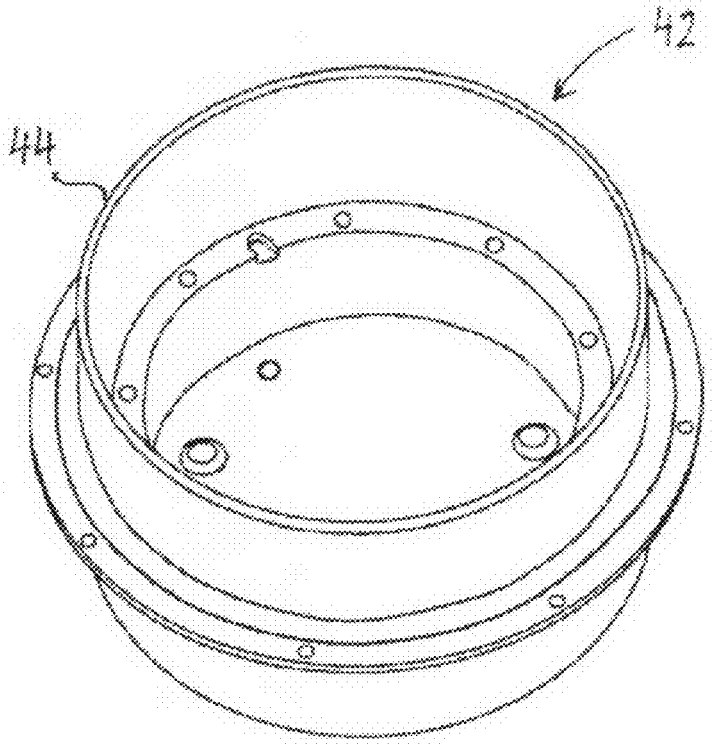
FIG. 8: is a perspective view of a metallic container for a stacked multi-band antenna.

FIG. 8 shows a perspective view of the antenna container 42 for accommodating the assembly of stacked patches 12, 14, excitation line section 20 and triplate 28 with the RF front end.

Figure 9:
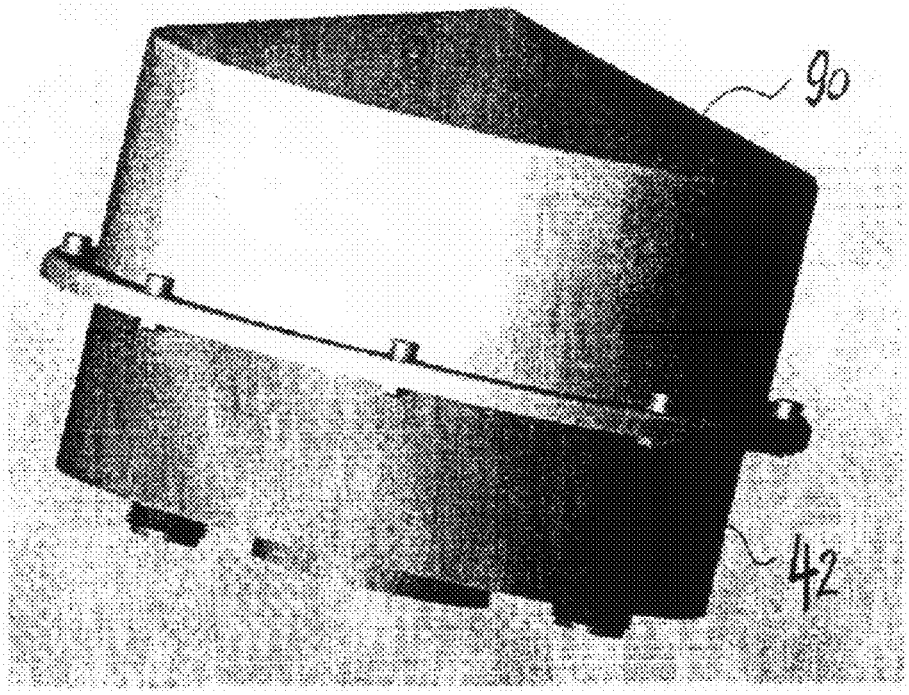
FIG. 9: is a perspective view of the metallic container of FIG. 8 covered with a radome for outdoor use.

For outdoor protection, e.g. against rainwater or snow, the antenna is preferably equipped with a radome 90, as illustrated in FIG. 9.

Those skilled in the art will appreciate that the antenna presented herein combines several functionalities, which make it especially well suited for professional satellite positioning applications, reference applications and safety-of-life applications, e.g. for the European satellite positioning system Galileo. The antenna provides for:

tri-band operation (e.g. L1, E5, E6);

intrinsic self-diplexing operation (separate circuits for the L1 band and the E5/E6 band);

high phase-centre stability and low-cross-polarisation level due to compactness and low profile.

The antenna has a high potential for commercial applications since it represents one of the first high performance antennas suitable for Galileo and it explores fully the technological potential of the Galileo system. Additionally, there is a need for such a price-accessible, compact and portable antenna with integrated filtering and amplifiers elements.

The invention claimed is:

1. A stacked multi-band antenna for a satellite positioning system comprising:

a stack of conductive patches, each respective conductive patch being dimensioned so as to be operative in a dedicated frequency band;

an excitation line section arranged underneath said stack of conductive patches, said excitation line section comprising pairs of conductive strips, each pair of conductive strips for radiatively coupling to an associate conductive patch of said stack of conductive patches; and at least one electric circuit for operatively connecting said pairs of conductive strips to a satellite positioning receiver, said at least one electric circuit being arranged in a triplate section arranged underneath said excitation line section, said triplate section comprising a first dielectric disk and a second dielectric disk plated with a conductive layer, said at least one electric circuit being sandwiched between the first dielectric disk plated with a conducting layer on a side facing away from the at least one electric circuit and the second dielectric disk plated with a conductive layer on a side facing away from the at least one electric circuit, said at least one electric circuit including filters and amplifiers for respectively filtering and amplifying signals from said pairs of conductive strips.

2. An antenna according to claim 1, wherein each of said pairs of conductive strips comprises two conductive strips of similar or equal length, which extend at right angle radially from a virtual point of intersection of said conductive strips, said point of intersection being located centrally underneath said conductive patches.

3. An antenna according to claim 1, wherein said excitation line section comprises two pairs of conductive strips, wherein a first conductive strip of one of said pairs of conductive strips is aligned with a respective first conductive strip of the other one of said pairs of conductive strips and wherein a second conductive strip of one of said pairs of conductive strips is aligned with a respective second conductive strip of the other one of said pairs of conductive strips.

4. An antenna according to claim 1, wherein said stack of conductive patches comprises rotationally symmetric patches.

5. An antenna according to claim 4, wherein said stack of conductive patches comprises a disk-shaped conductive patch and an annular conductive patch.

6. An antenna according to claim 1, wherein said stack of conductive patches comprises:

a first conductive patch dimensioned so as to be operative in a first frequency band and a second conductive patch dimensioned so as to be operative in a second frequency band distinct from said first frequency band;

and wherein said an excitation line section comprises:

a first pair of conductive strips for radiatively coupling to said first conductive patch, said first pair of conductive strips comprising a first and a second strip arranged substantially perpendicular to each other within said excitation line section and a second pair of conductive strips for radiatively coupling to said second conductive patch, said second pair of conductive strips comprising a first and a second strip arranged substantially perpendicular to each other within said excitation line section;

said antenna comprising a first electric circuit for connecting said first pair of conductive strips to said satellite positioning receiver and a second electric circuit for connecting said second pair of conductive strips to said satellite positioning receiver.

7. An antenna according to claim 6, wherein said first electric circuit comprises a first coupling stage for combining first frequency signals from said first strip of the first pair of conductive strips and first frequency signals from said second strip of the first pair of conductive strips with a relative phase difference of 90 degrees and wherein said second electric circuit comprises a second coupling stage for combining second frequency signals from said first strip of the second pair of conductive strips and second frequency signals from said second strip of the second pair of conductive strips with a relative phase difference of 90 degrees.

8. An antenna according to claim 7, wherein said first electric circuit comprises a band-pass filter and an amplifier for filtering, respectively amplifying, said combined first frequency signals from said first pair of conductive strips and wherein said second electric circuit comprises a band-pass filter and an amplifier for filtering, respectively amplifying, said combined second frequency signals from said second pair of conductive strips.

9. An antenna according to claim 6, wherein at least said second electric circuit comprises a diplexer with two band-pass filters for selecting two narrower frequency bands within said second frequency band.

10. An antenna according to claim 1, comprising dielectric substrate layers supporting said conductive patches.

11. An antenna according to claim 1, comprising a metallic container having a cavity, said stack of conductive patches and said excitation line section being arranged in said cavity.

12. An antenna according to claim 1, comprising a radome for protecting said antenna.

* * * * *